US006722652B2

(12) United States Patent
Kobayashi et al.

(10) Patent No.: US 6,722,652 B2
(45) Date of Patent: Apr. 20, 2004

(54) SHEET-FED PRESS AND INTERMEDIATE CYLINDER FOR SHEET-FED PRESS

(75) Inventors: Shinya Kobayashi, Hiroshima-ken (JP); Kazutada Dejima, Hiroshima-ken (JP); Hitoshi Hirose, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/193,669

(22) Filed: Jul. 12, 2002

(65) Prior Publication Data

US 2003/0020232 A1 Jan. 30, 2003

(30) Foreign Application Priority Data

Jul. 23, 2001 (JP) ..... 2001-221491
Mar. 8, 2002 (JP) ..... 2002-064101

(51) Int. Cl.[7] ..... B65H 5/04
(52) U.S. Cl. ..... 271/276; 271/194; 271/196
(58) Field of Search ..... 271/276, 194, 271/196

(56) References Cited

U.S. PATENT DOCUMENTS 3,663,012 A * 5/1972 Van Den Honert ..... 271/276
4,145,040 A * 3/1979 Huber ..... 271/276
4,202,542 A * 5/1980 Lammers et al. ..... 271/276
4,207,998 A * 6/1980 Schmid ..... 226/95
4,440,388 A * 4/1984 Divoux et al. ..... 271/195
4,790,244 A * 12/1988 Otfried et al. ..... 101/231
5,149,554 A * 9/1992 Abler ..... 426/420
5,329,301 A * 7/1994 Balzeit et al. ..... 346/134
5,913,268 A * 6/1999 Jackson et al. ..... 101/420
6,038,976 A * 3/2000 Helmstadter et al. ..... 101/410

FOREIGN PATENT DOCUMENTS

JP 2-5951 2/1990

* cited by examiner

*Primary Examiner*—Donald P. Walsh
*Assistant Examiner*—Matthew J. Kohner
(74) *Attorney, Agent, or Firm*—Armstrong, Kratz, Quintos, Hanson & Brooks, LLP

(57) ABSTRACT

An intermediate cylinder comprising a main body, and a plurality of suction boxes formed in the main body at positions different with respect to a rotation axis of the main body. The intermediate cylinder further comprises a plurality of suction bores formed in the suction boxes so that they are open at an outer peripheral surface of the main body, an air suction source for generating suction force within the suction boxes, and a switching means for selectively switching connections between the plurality of suction boxes and the air suction source.

15 Claims, 11 Drawing Sheets

SHEET-FED PRESS AND INTERMEDIATE CYLINDER FOR SHEET-FED PRESS

BACKGROUND OF THE INVENTION (1) Field of the Invention

The present invention relates generally to an intermediate cylinder for a sheet-fed press, and more particularly to an intermediate cylinder which is installed after a printing unit to adjust the traveling posture of a sheet being fed from the printing unit so that the sheet is stably conveyed. This invention also relates to a sheet-fed press with such an intermediate cylinder.

(2) Description of the Related Art

A wide variety of perfecting presses have lately been proposed and put to practical use.

FIG. 9 illustrates a perfecting press of a type where one-color printing is performed on both sides of a sheet 4. This press includes a reverse-side printing unit 1 disposed on the upstream side of a sheet traveling path along which the sheet 4 is traveled, and an obverse-side printing unit 2 disposed on the downstream side of the sheet traveling path.

In addition to the reverse-side printing unit 1 and the obverse-side printing unit 2, the sheet-fed press further includes a sheet feeder 19, a feeder board section 20, two intermediate cylinders 3*a*, 3*b* installed between the reverse-side printing unit 1 and the obverse-side printing unit 2 to convey the sheet 4 to the downstream side, a paper discharge unit 21, and so on.

The paper discharge unit 21 is constructed of a sheet conveyor 22, a sheet stacker 23 provided under the downstream end of the sheet conveyor 22, and so on.

The sheet feeder 19 is provided with a paper feed table 30 on which sheets 4 to be printed are stacked, and is operative to feed the uppermost sheet 4 in accordance with consumption speed (mechanical speed) when printing is performed. The sheet 4 fed by the sheet feeder 19 is conveyed by the feeder board section 20 to a first guide cylinder 24 disposed in the introducing portion of the reverse-side printing unit 1.

The sheet 4 is delivered from the first guide cylinder 24 to a second guide cylinder 25 and to the press cylinder 5*a* of the reverse-side printing unit 1, in which printing is performed on the reverse side of the sheet 4. Subsequently, the sheet 4 is conveyed by first and second intermediate cylinders 3*a*, 3*b* and delivered to the press cylinder 5*b* of the obverse printing unit 2, in which printing is performed on the obverse side of the sheet 4.

As shown in FIG. 11, the printing unit 2 (or 1) includes an ink reservoir 31, an ink roller group 32, a plate cylinder 34 with a printing plate 33 wound thereon, a blanket cylinder 35, a press cylinder 5, a wetter 36, and so on. The ink 18 supplied to the ink reservoir 31 is kneaded to the desired degree through the ink roller group 32 and transferred to the printing plate 33. The ink 18 is further transferred as an image to the outer peripheral surface of the blanket cylinder 35.

At the same time, wetting water is supplied to the blanket cylinder 35 from the wetter 36. Thereafter, the image transferred to the blanket cylinder 35 is transferred to the surface of the sheet 4 being traveled through the gap between the blanket cylinder 35 and the press cylinder 5. In this way, a predetermined printing is completed.

In FIG. 9, while the single reverse-side printing unit 1 and the single obverse-side printing unit 2 are shown, there is also a multiple color press in which a plurality of reverse-side printing units 1 and/or obverse-side printing units 2 differing in ink color are juxtaposed along the sheet traveling direction. In either case, the number of printing units 1, 2 is determined according to circumstances.

The printed sheet 4 is conveyed from the press cylinder 5*b* of the second printing unit 2 to the sheet conveyor 22 of the paper discharge unit 21. And the printed sheet 4 is gripped and conveyed onto the sheet stacker 23 by a chain gripper provided in an endless chain 28 being driven by a paper discharge shaft 27, and is stacked on the paper discharge table 29 of the sheet stacker 23. Subsequently, if a fixed quantity of sheets are stacked, then they are removed from the paper discharge table 29, After printing is performed on the reverse side of the sheet 4, the ink 18 on the reverse side is dried at the outer peripheral surface of the second intermediate cylinder 3*b* by the first drier 17 disposed near the intermediate cylinder 3*b*. After printing is performed on the obverse side of the sheet 4, the ink 18 on the obverse side is dried by the second drier 17 when the sheet 4 is being gripped and conveyed by the gripper of the endless chain 22 which travels along the outer peripheral surface of the paper discharge shaft 27 from the press cylinder 5*b*.

Most of the sheet-fed presses use ink that is dried and hardened by ultraviolet rays (UV). Therefore, UV driers for irradiating ultraviolet rays are often installed. However, it is desirable to install driers in accordance with the characteristics of ink used.

In the prior art sheet-fed press constructed as described above, the drying effect of the drier 17 is not sufficiently obtained at the second intermediate cylinder 3*b* which conveys the sheet 4 to the obverse-side printing unit 2 after printing is performed by the reverse-side printing unit 1. Because of this, poor drying such as uneven drying will occur, or the printing surface will be stained or scored.

The inventors have made various investigations and experiments and found that the above-described problems result mainly from flap of a sheet against an intermediate cylinder.

(1) The sheet 4 is conveyed with the front end gripped by the pawl member 26 of the intermediate cylinder 3. As shown in FIG. 10, means to control the posture of the sheet 4 is not present on the tail side of the sheet 4, and consequently, the sheet tail is free to move. Because of this, during conveyance, the sheet tail is separated from the surface (outer peripheral surface) of the intermediate cylinder 3 by the centrifugal force caused by rotation of the intermediate cylinder 3 and gravity. As a result, flap of the sheet 4 against the intermediate cylinder 3 is caused and the traveling posture of the sheet 4 becomes unstable.

(2) Because of the flap of the sheet 4 against the intermediate cylinder 3, the drying effect of the drier 17 is not sufficiently obtained and therefore there is a possibility that poor drying such as uneven drying will occur.

(3) If the sheet 4 is separated from the intermediate cylinder 3 because of centrifugal force, etc., the separated rear end portion will make contact with the drier 17, and consequently, the printing surface will be stained or scored.

(4) For the above-mentioned reasons, printing quality is considerably reduced and therefore there are cases where a great number of sheets are damaged.

In Japanese Utility Model Publication No. HEI 2-5951, there is disclosed a paper sending cylinder that sends a sheet to various cylinders on the downstream side while holding the sheet by suction. The paper sending cylinder is equipped with (1) an air tank provided in the cylinder end thereof, (2) a plurality of suction ducts held in fluid communication with the air tank and extending in the axial direction of the paper sending cylinder and provided so that they differ in phase in the circumferential direction, and (3) suction bores formed from the suction ducts to the outer peripheral surface of the paper sending cylinder. By actuating an external suction unit connected with the air tank, a sheet can be held on the outer peripheral surface of the paper sending cylinder by suction through the suction bores.

In the paper sending cylinder, shutter plates are inserted between the air tank and the suction ducts. A plurality of shutter plates are previously prepared. Each shutter plate has a through hole that is aligned with one of the suction ducts differing from one another. If a suitable shutter plate of the shutter plates is selected and used, a predetermined suction duct of the suction ducts provided so that they differ in phase in the circumferential direction can be selectively communicated with the air tank. In this way, the tail of the sheet can be held by suction through the suction bores formed at suitable positions in accordance with the size of the sheet.

In this technique, however, an operation of exchanging shutter plates must be performed each time a sheet of a different size is used. The shutter plate is inserted into a predetermined portion of the paper sending cylinder and is fastened with bolts. Thus, the exchanging operation is a troublesome operation involving time-consuming efforts.

SUMMARY OF THE INVENTION

The present invention overcomes the problems associated with the prior art. Accordingly, it is an object of the present invention to provide a sheet-fed press and an intermediate cylinder for a sheet-fed press that are capable of easily changing the settings of the press even if a sheet of a different size is used. Another object of the invention is to provide a sheet-fed press and an intermediate cylinder for a sheet-fed press which are capable of preventing poor drying and the occurrence of stains and scores in the printing surface by suppressing flap of a sheet against the intermediate cylinder which is to be described later.

In accordance with a form of the present invention, there is provided an intermediate cylinder that is used in a sheet-fed press to convey a sheet. The intermediate cylinder comprises a main body, a plurality of suction boxes formed in the main body at positions different with respect to a rotation axis of the main body (at different circumferential positions of the main body), and a plurality of suction bores formed on the suction boxes so that they are open at the outer peripheral surface of the main body. The intermediate cylinder further comprises suction force generation means for generating suction force within the suction boxes, and switching means for selectively switching connections between the plurality of suction boxes and the suction force generation means.

In accordance with another form of the present invention, there is provided a sheet-fed press including the above-described intermediate cylinder.

It has been found that providing suction boxes in a portion of the intermediate cylinder is effective to prevent flap of the sheet against the intermediate cylinder.

According to the intermediate cylinder and the sheet-fed press of the present invention, the sheet is held on the outer peripheral surface of the intermediate cylinder by suction, and consequently, flap of the sheet against the intermediate cylinder can be prevented. Therefore, in the case where the intermediate cylinder is disposed to face the drier, the drying effect of the drier is sufficiently obtained and poor drying such as uneven drying can be prevented. In addition, as contact between the sheet and drier is prevented, the printing surface can be prevented from being stained or scored.

Further in accordance with the present invention, connections between the suction boxes and the suction force generation means can be switched by the switching means, and the generation of suction force within the suction boxes disposed at different circumferential positions can be selected by the switching means. Therefore, to stably hold the sheet tail on the intermediate cylinder by suction, the operation of adjusting a position at which the sheet is held on the intermediate cylinder by suction can be easily performed by operation of the switching means.

In addition, it has been found that if a sheet-fed press is made by combining the above-described intermediate cylinder with the drier, the above-described problems can be greatly overcome. Moreover, it has been found that if the intermediate cylinder is provided with air jet means, the above-described problems can be more effectively overcome. The air jet means is operative to jet air so that the sheet delivered to the intermediate cylinder is stretched along the outer peripheral surface of the intermediate cylinder.

The above and many other objects, features and advantages of the present invention will become manifest to those skilled in the art upon making reference to the following detailed description and accompanying drawings in which preferred embodiments incorporating the principle of the present invention are shown by way of illustrative example.

DESCRIPTION OF THE PREFERRED EMBODIMENTS

Figure 1:
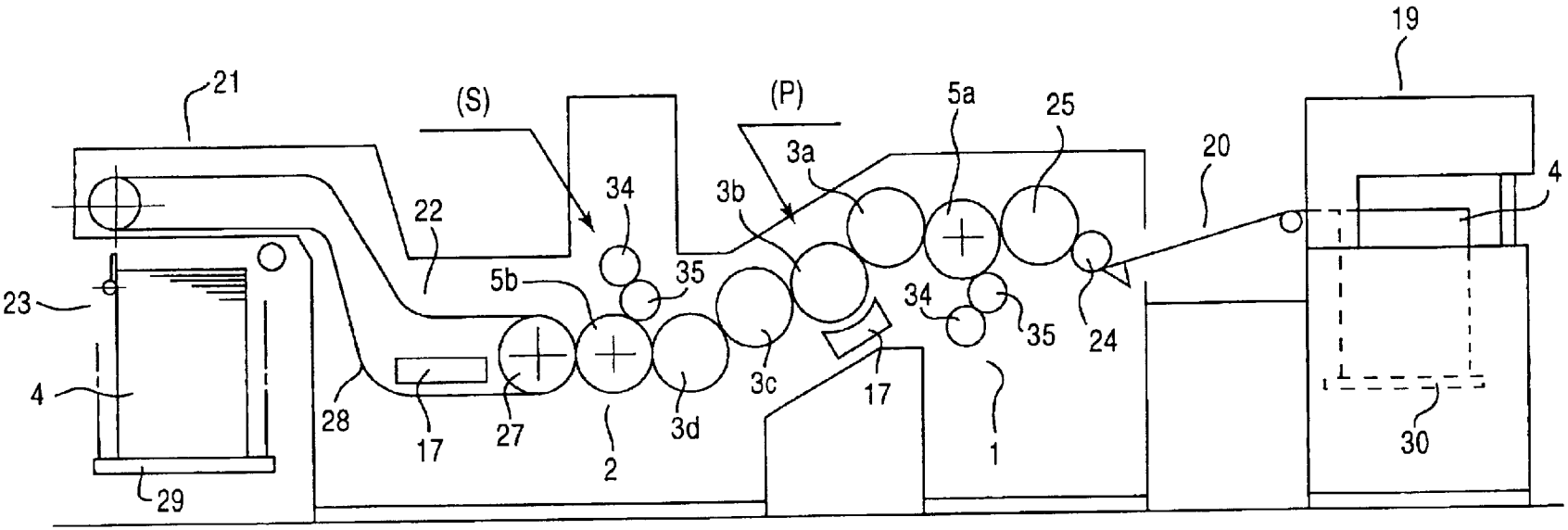
FIG. 1 is a sectional side view showing a sheet-fed press constructed in accordance with a first embodiment of the present invention.

Preferred embodiments of the present invention will hereinafter be described with reference to the drawings. The same reference numerals denote the same parts as those previously described in the prior art. Note that since the drawings and following description are for the purpose of illustrating the present invention and not for the purpose of limiting the same, it will be apparent to those skilled in this art that various changes and modifications may be made without departing from the scope of the appended claims.

The fundamental construction of a sheet-fed press according to the present invention is the same as that of the conventional sheet-fed press previously described and therefore a detailed description is omitted for avoiding redundancy.

(A) First Embodiment

Figure 2:
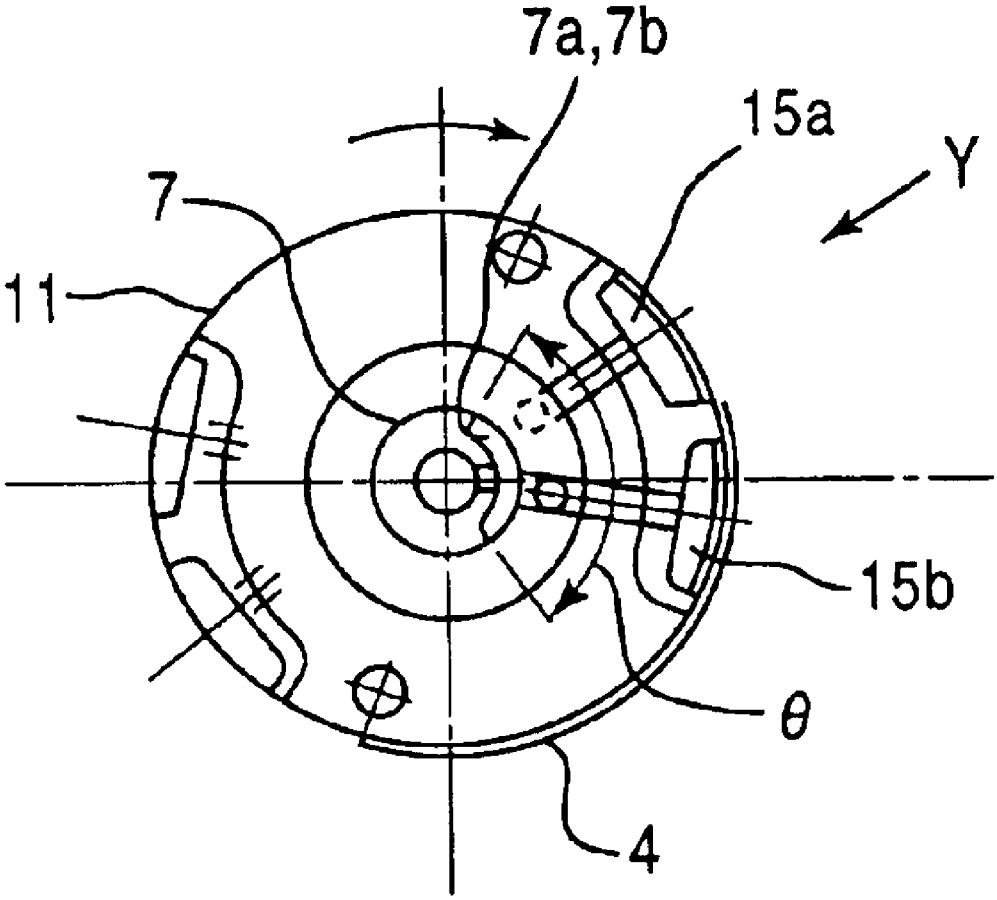
FIG. 2 is a cross sectional view (taken substantially along line X—X of FIG. 3) of an intermediate cylinder used in the first embodiment of the present invention.
Figure 3:
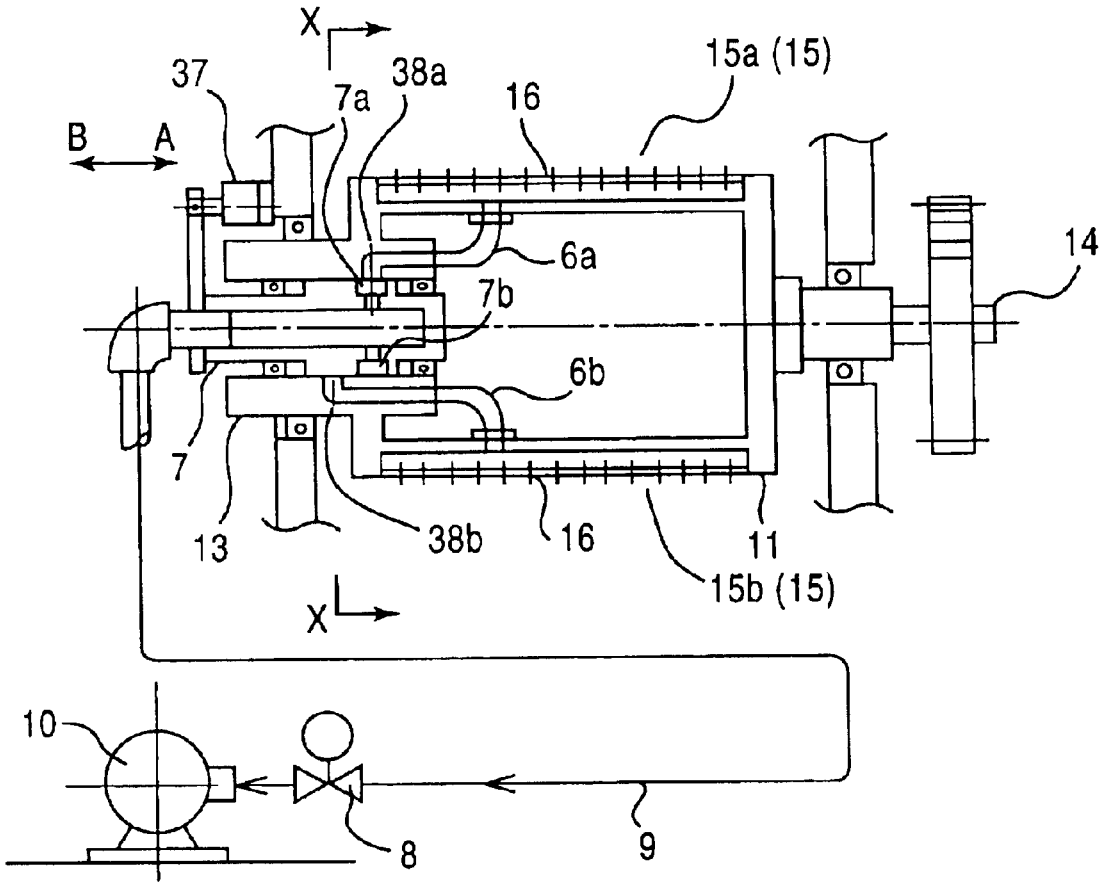
FIG. 3 is a longitudinal sectional view of the intermediate cylinder used in the first embodiment.
Figure 4:
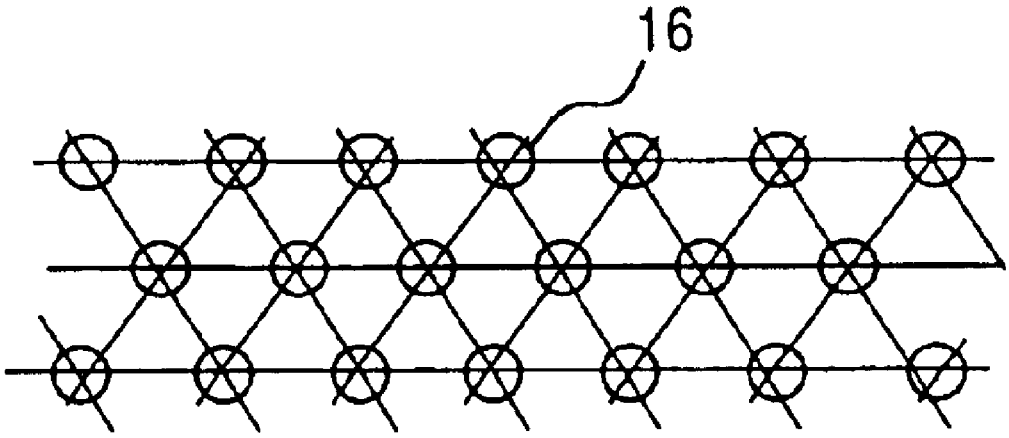
FIG. 4 is a plan view (taken in the direction of arrow Y in FIG. 2) showing an example of the arrangement of suction bores formed in the intermediate cylinder shown in FIGS. 2 and 3.

FIGS. 2 to 4 show a sheet-fed press constructed in accordance with a first embodiment of the present invention.

FIG. 2 is a cross sectional view showing the structure of an intermediate cylinder (suction cylinder) used in the sheet-fed press of the first embodiment, and FIG. 3 is a longitudinal sectional view of the intermediate cylinder. FIG. 4 shows an example of the arrangement of suction bores formed in the intermediate cylinder.

In the first embodiment, 4 (four) intermediate cylinders 3*a* to 3*d* are installed between a reverse-side printing unit 1 and an obverse-side printing unit 2 in FIG. 1, and only the second intermediate cylinder 3*b* has a suction mechanism which is provided in the outer peripheral surface thereof. That is, the second intermediate cylinder 3*b* is configured to hold a sheet 4 on the outer peripheral surface thereof by suction to convey the sheet 4 stably. More specifically, the second intermediate cylinder 3*b* includes a cell (main body) 11, a rotating shaft 14 for rotating the cell 11 integrally therewith, and a suction shaft 13. A portion of the outer peripheral surface of the main body 11 is provided with a suction box 15 that has a suction function. The suction box 15 is configured to hold the tail of the sheet 4 on the outer peripheral surface thereof by suction. Therefore, the sheet 4 can be stably conveyed as described above.

In the first embodiment, suction boxes 15*a*, 15*b* are provided at two different positions on the second intermediate cylinder 3*b*, as shown in FIGS. 2 and 3.

The suction boxes 15*a*, 15*b* are connected to the suction shaft ports 38*a*, 38*b* of the suction shaft 13 via connection tubes 6*a*, 6*b*, respectively. The suction boxes 15*a*, 15*b* are further connected to a suction pipe 9, a control valve 8, and an air suction source or suction pump (suction force generation means) 10 via the suction valve ports 7*a*, 7*b* of a switching valve (switching means) 7. The switching valve 7 is axially movable by an air cylinder (air actuator) 37 so that it can switch the positions at which suction is performed. Therefore, the actuation and non-actuation of suction can be arbitrarily performed. The outer peripheral surfaces of the suction boxes 15*a*, 15*b* (which form the outer peripheral surface of the second intermediate cylinder 3*b*) have a plurality of air suction bores 16. If the suction pump 10 is actuated, negative pressure is generated within the suction box 15 and therefore air can be introduced into the suction box 15 via the air suction bores 16. Because of this, the sheet 4 is conveyed while being held on the outer peripheral surface of the second intermediate cylinder 3*b* by suction, and is sent to the third intermediate cylinder 3*c*. Therefore, the sheet 4 is dried by a drier 17 without being separated from the second intermediate cylinder 3*b* (i.e., without flap of the sheet 4 against the second intermediate cylinder 3*b*), and is sent to the third intermediate cylinder 3*c*.

In the first embodiment, while two suction boxes 15*a*, 15*b* are provided, the present invention is not limited to the two. One or a plurality of suction boxes may be provided. In the case where a plurality of suction boxes are provided, they can be selectively used according to the length of a sheet.

The suction operation is started when the tail of the sheet 4 is conveyed from the first intermediate cylinder 3*a* to the second intermediate cylinder 3*b*, and is stopped before the sheet 4 is conveyed from the second intermediate cylinder 3*b* to the third intermediate cylinder 3*c*.

The suction timing and the number of suction boxes are suitably determined according to various conditions. To obtain stable suction performance, tests and simulations are previously made and the suction timing and the number of suction boxes are determined by trial and error.

If the suction timing and the number of suction boxes are improper, there are cases where the effect of preventing flap of the sheet 4 against the intermediate cylinder 3*b* is not sufficiently obtained. On the other hand, if the suction time is set too long, or the number of suction boxes is greatly increased, air will be wastefully introduced into the suction boxes. It also involves waste of equipment. Note that the amount that air is introduced into the suction boxes 15*a*, 15*b* can also be determined by trial and error.

Referring to FIG. 4, there is depicted an example of the arrangement of the suction bores 16 in the surface of the suction box 15*a*. The number and shape of suction bores 16 can be suitably determined by tests, etc.

Thus, according to the present invention, flap of the sheet 4 against the intermediate cylinder 3*b* can be prevented by providing the suction boxes 15*a*, 15*b* in the intermediate cylinder 3*b*. As a result, the drying effect of the drier 17 is effectively obtained. Therefore, poor drying such as uneven drying can be prevented, and the printing surface can be prevented from being stained or scored.

In addition, the suction boxes 15*a*, 15*b* can be selectively used. The suction boxes 15*a*, 15*b* are switched by axially moving the switching valve 7 by actuation of the air cylinder 37. That is, as shown in FIG. 3, in the state where the driving shaft of the air cylinder 37 is contracted to position A, the first suction shaft port 38*a* in the suction shaft 13 is aligned with the first suction valve port 7*a* formed in the switching valve 7, and therefore, only the first suction box 15*a* is connected with the suction pump 10 via the switching valve 7 and is caused to be in a suction state. On the other hand, with the driving shaft of the air cylinder 37 protruded to position B, the second suction shaft port 38*b* in the suction shaft 13 is aligned with the second suction valve port 7*b* formed in the switching valve 7, and therefore, only the second suction box 15*b* is connected with the suction pump 10 via the switching valve 7 and is caused to be in a suction state.

For instance, when the sheet 4 is short the second suction box 15*b* is used, and when it is long the first suction box 15*a* is used. In this manner, the tail of the sheet 4 can be stably held on the second intermediate cylinder 3*b* by suction.

An actuator for the switching valve 7 is not limited to the air cylinder 37, but may employ various types such as an electric motor. In the case where an electric motor is used as the actuator, the switching valve 7 can be axially moved, for example, by a rack-and-pinion mechanism.

The timing at which suction is started and stopped is determined by the angle θ and position of the suction valve ports 7*a*, 7*b* in FIG. 2. The position of the suction valve ports 7*a*, 7*b* can also be changed by holding the switching valve 7 so that it is rotatable. As shown in FIG. 2, the suction valve ports 7*a*, 7*b* in the switching valve 7 are formed along the outer peripheral surface of the switching valve 7 into the shape of an arc. In the range where the arcuate suction valve ports 7*a*, 7*b* are aligned with the suction shaft ports 38*a*, 38*b* of the suction shaft 13, suction is performed by the suction boxes 15*a*, 15*b*. The above-described port angle θ refers to the angle of the arc of the suction valve ports 7*a*, 7*b*.

As described above, the suction boxes 15*a*, 15*b* can be selectively used depending on the length of the sheet 4. Therefore, there is an advantage that the sheet 4 can be stably held by suction independently of the sheet length. In addition, there is an advantage that switching of the suction boxes 15*a*, 15*b* can be easily and automatically performed by controlling only actuation of the air cylinder 37. Note that the present invention is not limited to the suction boxes 15*a*, 15*b* employed in the first embodiment, but may adopt any suction mechanism well known in the prior art.

(B) Second Embodiment

Figure 5:
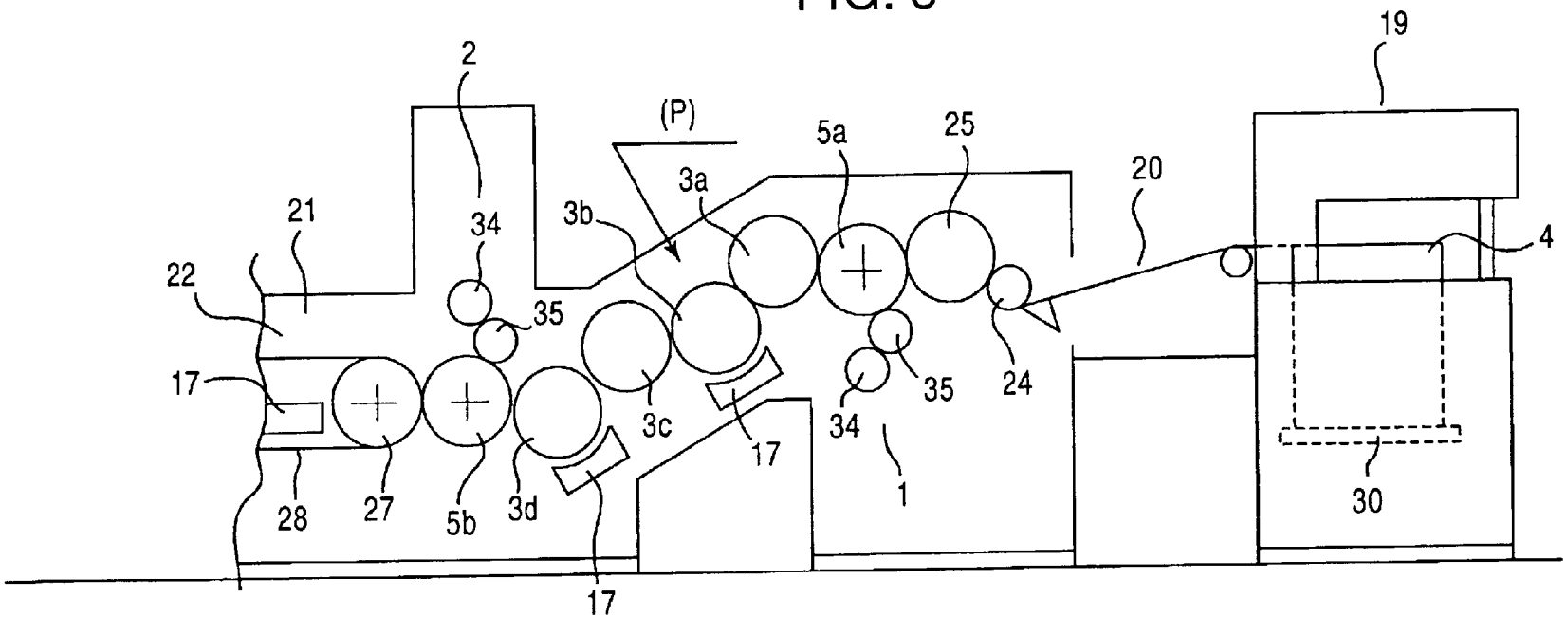
FIG. 5 is a sectional side view showing a sheet-fed press constructed in accordance with a second embodiment of the present invention.

FIG. 5 shows a sheet-fed press constructed in accordance with a second embodiment of the present invention. In the second embodiment, two intermediate cylinders (intermediate suction cylinders) according to the present invention are installed in the sheet-fed press.

As shown in FIG. 5, in a perfecting press constructed to perform one-color printing on both sides of a sheet 4, a second intermediate cylinder 3*b* and a fourth intermediate cylinder 3*d* according to the second embodiment are installed between the press cylinder 5*a* of a reverse-side printing unit 1 and the press cylinder 5*b* of an obverse-side printing unit 2. In addition, two driers 17 are installed in close proximity to the second and fourth intermediate cylinders 3*b* and 3*d*, respectively. The fundamental printing functions are the same as those described in the conventional perfecting press.

In FIG. 5, two driers 17 are provided and two intermediate cylinders 3*b*, 3*d* corresponding to the two driers 17 are configured as the intermediate suction cylinders of the present invention. Therefore, during drying, flap of the sheet 4 against the intermediate cylinders 3*b*, 3*d* can be prevented. In addition to the advantages of the first embodiment, the capability to dry the printing surfaces can be improved. Because of this, the printing speed can be enhanced and an enhancement in the productivity can be achieved.

Furthermore, if the diameter of the intermediate cylinders 3*b*, 3*d* corresponding to the two driers 17 is increased, then it is possible to increase the area of the sheet 4 that can be dried at once, and consequently, it is possible to further improve the drying function (efficiency).

(C) Third Embodiment

Figure 6:
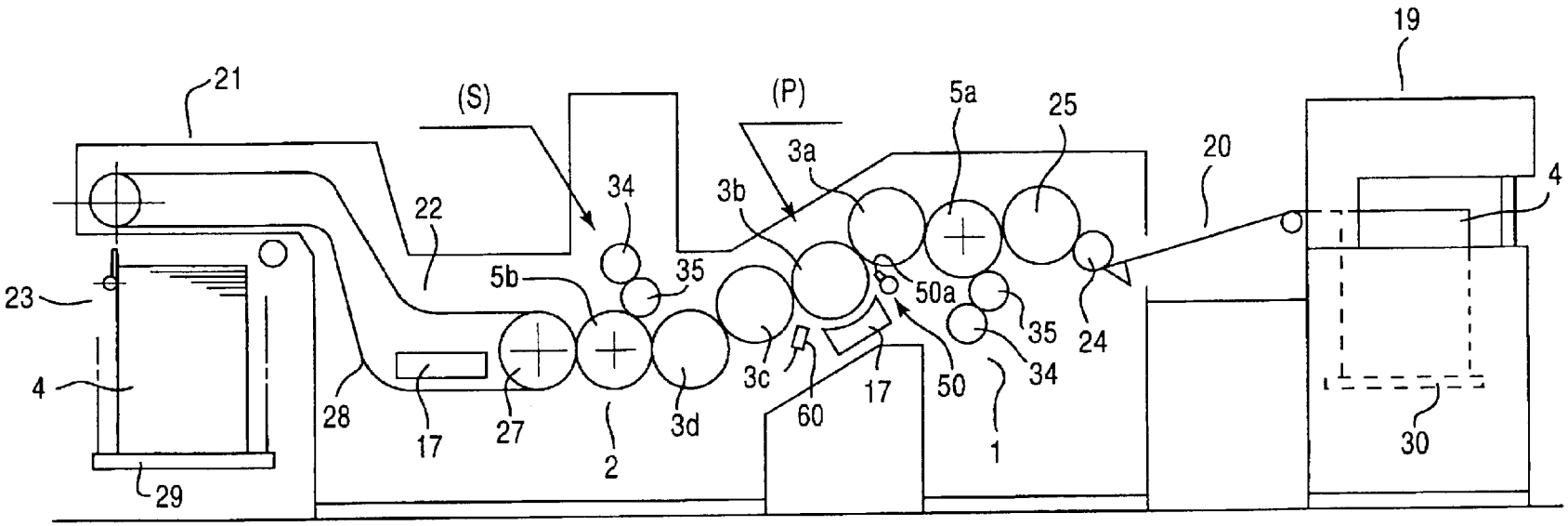
FIG. 6 is a sectional side view showing a sheet-fed press constructed in accordance with a third embodiment of the present invention.
Figure 7:
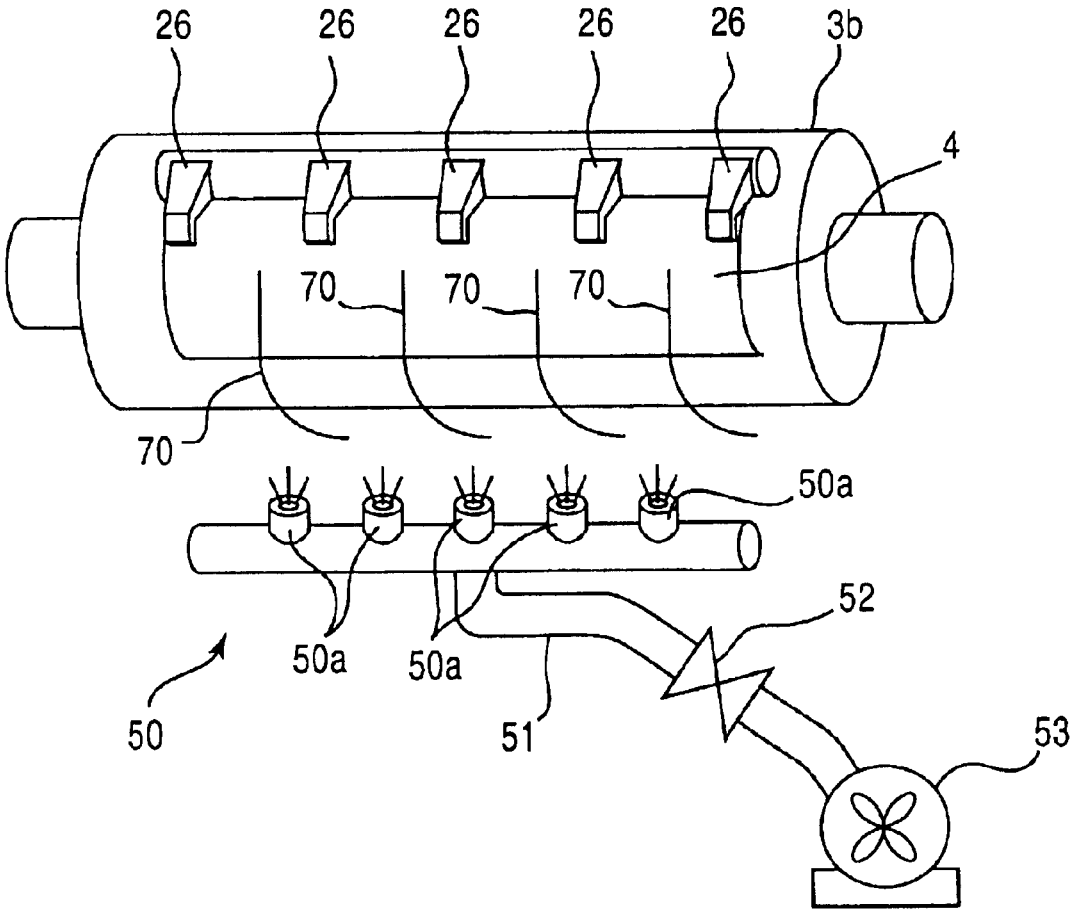
FIG. 7 is a perspective view showing the intermediate cylinder and air jet means of the sheet-fed press of the third embodiment.
Figure 8:
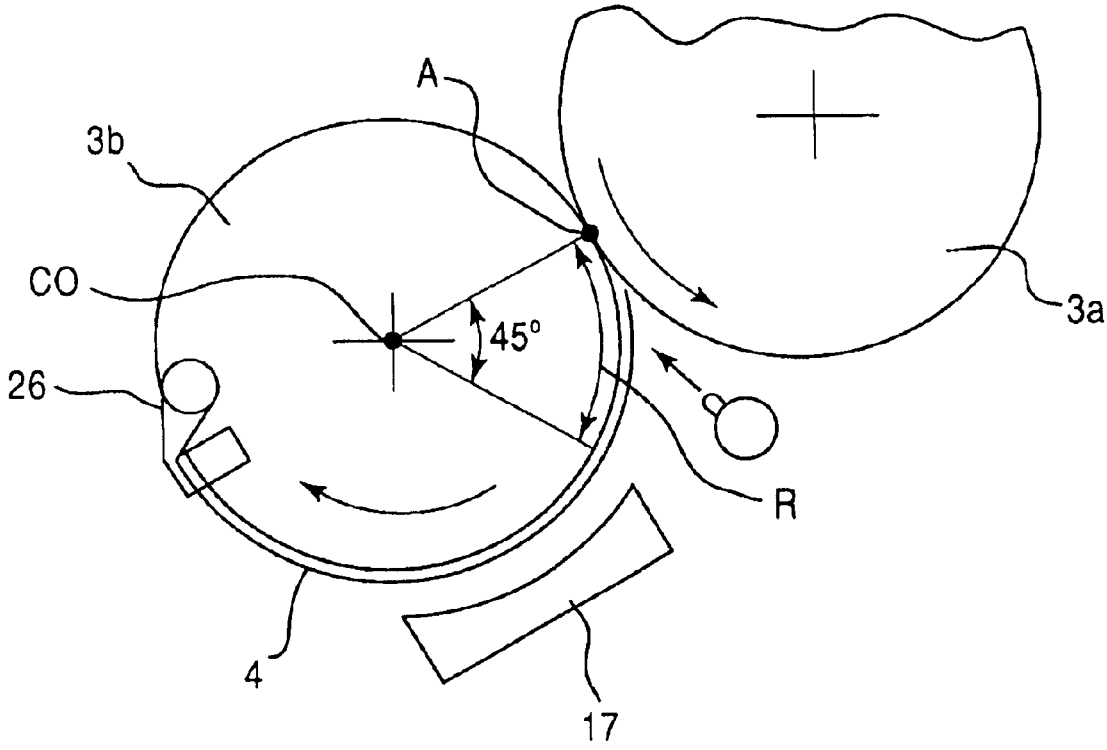
FIG. 8 is a side view used to explain a preferred range of directions in which air is jetted by the air shower of the sheet-fed press of the third embodiment.
Figure 9:
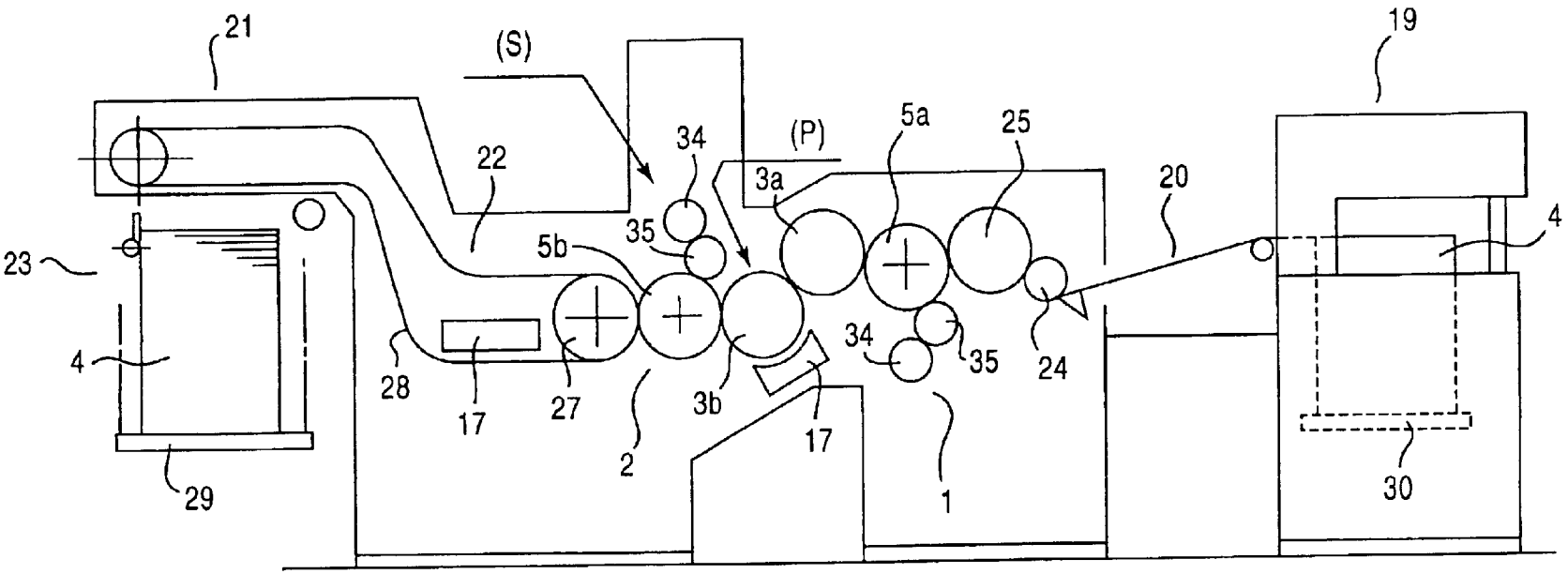
FIG. 9 PRIOR ART
FIG. 9 is a sectional side view showing a conventional sheet-fed press.
Figure 10:
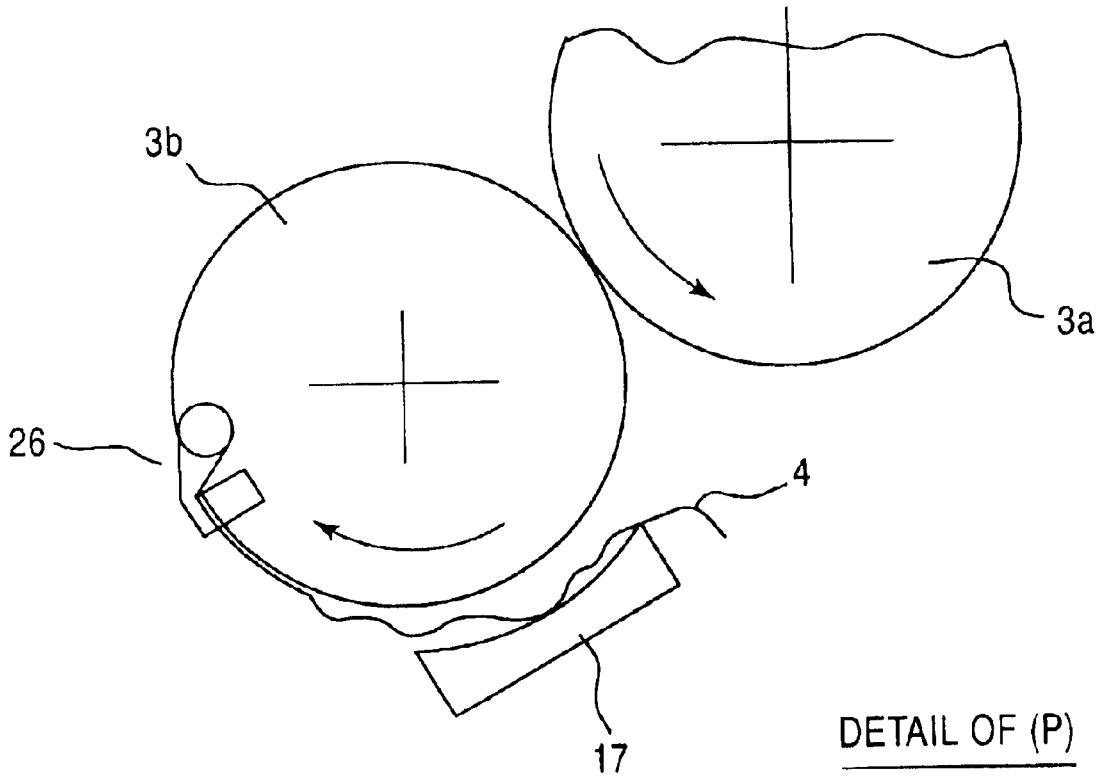
FIG. 10 PRIOR ART
FIG. 10 is a diagram used for explaining problems associated with the intermediate cylinder of the conventional sheet-fed press.
Figure 11:
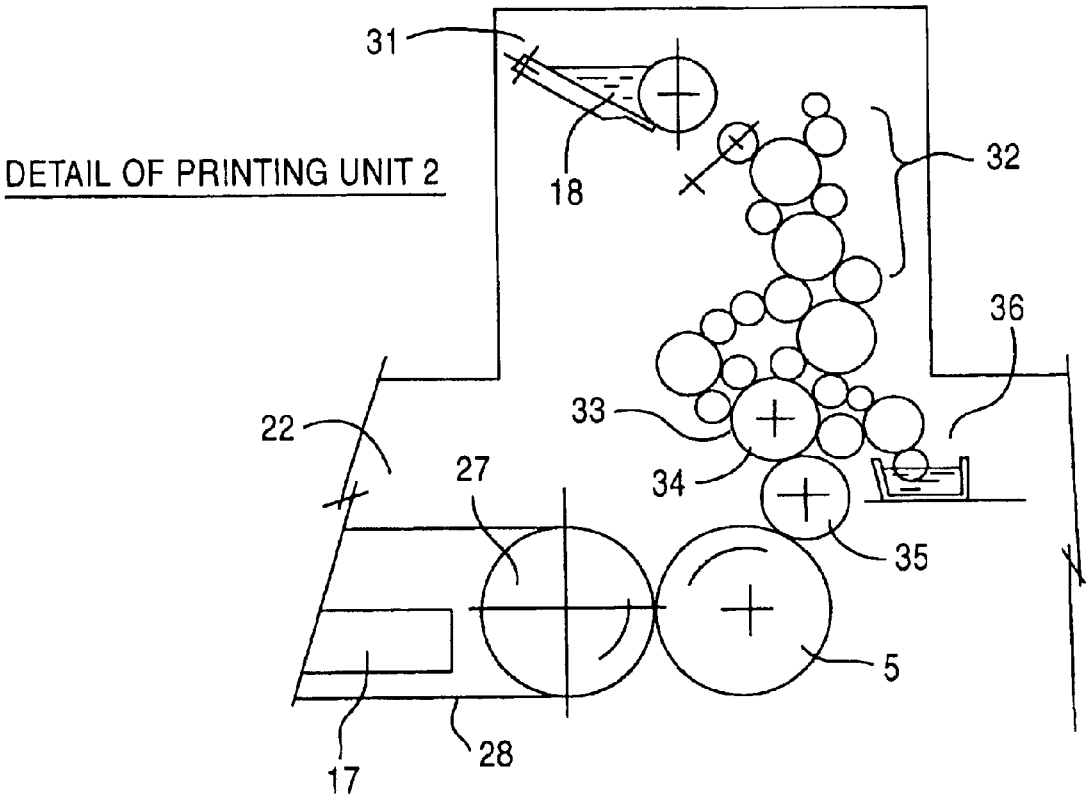
FIG. 11 PRIOR ART
FIG. 11 is a sectional side view showing a printing unit.

FIGS. 6 to 8 show a sheet-fed press constructed in accordance with a third embodiment of the present invention.

FIG. 6 is a sectional side view of the sheet-fed press of the third embodiment, FIG. 7 is a perspective view showing the intermediate cylinder and air jet means of the third embodiment, and FIG. 8 is a side view of the intermediate cylinder used for explaining a preferred range of positions where air is jetted by an air shower 50.

In the sheet-fed press of the third embodiment, as shown in FIG. 6, an air shower 50 as air jet means and an imaging sensor 60 as imaging means (e.g., a CCD camera, a COMS or infrared sensor, etc.) 60 are added to the sheet-fed press of the first embodiment.

The air shower 50 is provided with a plurality of air jet ports 50*a* which face a second intermediate cylinder 3*b*. The second intermediate cylinder 3*b* is provided with a drier 17 across a traveling line for a sheet 4. As shown in FIG. 7, the air jet ports 50*a* of the air shower 50 are disposed along the axial direction of the second intermediate cylinder 3*b*. The air shower 50 is connected to an external air blower 53 through an air pipe 51. If the air blower 53 is actuated, air can be continuously jetted from the air jet ports 50*a* to approximately the entire width of the second intermediate cylinder 3*b*. Note that only when the sheet 4 is situated in the air jet region of the air shower 50, air may be jetted by the air shower 50.

The air jet ports 50*a* vary in pitch and diameter in the axial direction of the second intermediate cylinder 3*b* (i.e., the direction of the width of the sheet 4) so that the strength of air is gradually reduced from the axial center of the intermediate cylinder 3*b* toward the axial opposite ends. Therefore, the sheet 4 can be stretched in the direction of the sheet width as well as the direction in which the sheet 4 is conveyed. Note that the pitch between the air jet ports 50*a* and the jet port diameter may be made constant regardless of the positions of the ports 50*a* in the direction of the width of the sheet 4.

The air pipe 51 is provided with a pressure control valve 52, which is used to control the air jet pressure of the air blower 53 to a predetermined pressure which is set depending on paper type, etc. In FIG. 7, reference numeral 70 denotes a bar-shaped sheet guide for guiding the sheet 4 being conveyed by the second intermediate cylinder 3*b*.

With such a construction, as shown in FIG. 8, the tail of the sheet 4 being conveyed by the intermediate cylinder 3*b* is stretched along the peripheral surface of the intermediate cylinder 3*b*. This is called the paper stretching effect. (In FIG. 8, there is shown a gap between the sheet 4 and the intermediate cylinder 3*b* for convenience.) The paper stretching effect can prevent the sheet 4 from being held on the intermediate cylinder 3*b* in a slack state. The effect can also prevent a slack part of the sheet 4 from contacting the drier 17 and being scored.

In addition, since the sheet 4 is brought into close contact with the intermediate cylinder 3*b* by air jetted from the air shower 50, the sheet 4 can be stably held on the intermediate cylinder 3*b* by suction.

It is preferable that the air shower 50 jet air toward the outer peripheral surface of the intermediate cylinder 3*b* in a predetermined region R shown in FIG. 8. The region R is a region of 45 degrees, measured downward from position A where the sheet 4 is received from the first intermediate cylinder 3*a* by the second intermediate cylinder 3*b*, with the rotation axis CO of the intermediate cylinder 3*b* as center.

As shown in FIG. 6, the imaging sensor (imaging means) 60 is disposed near the second intermediate cylinder 3*b* so that it can photograph the printing surface (the side opposite to the held surface) of the sheet 4 held on the intermediate cylinder 3*b* by suction. The information obtained by the imaging sensor 60 is output to an analyzing device (not shown) so that the printing quality of the reverse side of the sheet 4 can be analyzed and detected. Alternatively, the information obtained by the imaging sensor 60 may be output to a display unit (not shown) so that the printing quality of the reverse side can be monitored by the operator.

Because the sheet-fed press of the third embodiment is constructed as described above, the suction of the sheet 4 by the intermediate cylinder 3*b* is stably performed and therefore the advantages of the above-described embodiments are more effectively obtained.

In addition, since the reverse side can be photographed with the sheet 4 held on the intermediate cylinder 3*b* by suction, there is also an advantage that, based on the photographed reverse side, the printing quality of the reverse side can be detected with a high degree of accuracy.

The third embodiment does not always need to include the air shower 50. That is, it is also possible to add only the imaging sensor 60 to the second intermediate cylinder 3*b* which has a suction mechanism. In addition, in the third embodiment, while the air shower 50 and the imaging sensor 60 are disposed near the second intermediate cylinder 3*b*, they may also be disposed near the fourth intermediate cylinder 3*d*.

(D) Others

While the present invention has been described with reference to the preferred embodiments thereof, the invention is not to be limited to the details given herein. It will be apparent to those skilled in this art that various changes and modifications may be made without departing from the scope of the invention hereinafter claimed.

While the intermediate cylinder used in printing both sides of a sheet has been described, the present invention is not limited to this. The present invention is applicable to any case including one-side printing, as long as the above-described problems (i.e., the insufficiency of the drying effect of the drier 17, poor drying such as uneven drying, and occurrence of stains and scores in a printing surface) are overcome by preventing flap of the sheet 4 against the intermediate cylinder.

In the above-described embodiments, while the reverse-side printing unit 1 and the obverse-side printing unit 2 are arranged from the upstream side of the traveling direction of the sheet 4 in the recited order, they may be arranged in reversed order. Although 4 (four) intermediate cylinders are disposed between the reverse-side printing unit 1 and the obverse-side printing unit 2, the number of intermediate cylinders between the reverse-side printing unit land the obverse-side printing unit 2 is well if it is the number of press cylinders around which different sides of the sheet 4 are wound as printing surfaces. This is, the number is well if it is an even number.

What is claimed is:

1. An intermediate cylinder which is used in a sheet-fed press to convey a sheet, said intermediate cylinder comprising:

a main body;

at least one set of a gripping mechanism and a plurality of suction boxes, said gripping mechanism being disposed at a predetermined circumferential position of said main body and being for gripping a front end of said sheet, and said plurality of suction boxes, each of which being for sucking and holding a tail of said sheet whose front end is gripped by said gripping mechanism, being disposed in said main body at different distances from said gripping mechanism;

a plurality of suction bores formed in said suction boxes so that they are open at an outer peripheral surface of said main body;

suction force generation means for generating suction force within said suction boxes; and switching means for selectively switching connections between said plurality of suction boxes and said suction force generation means.

2. The intermediate cylinder as set forth in claim 1, further comprising an actuator connected said switching means for actuating said switching means.

3. The intermediate cylinder as set forth in claim 2, wherein said actuator comprises a fluid pressure cylinder.

4. The intermediate cylinder as set forth in claim 2, wherein said actuator comprises an electric motor.

5. The intermediate cylinder as set claim 1, said intermediate cylinder disposed to face a drier for said sheet.

6. The intermediate cylinder as set claim 2, said intermediate cylinder disposed to face a drier for said sheet.

7. A sheet-fed press with the intermediate cylinder as set forth in claim 1.

8. The sheet-fed press as set forth in claim 7 wherein: a reverse-side printing unit and an obverse-side printing unit are arranged along a traveling path for said sheet; said reverse-side printing unit is operative to perform printing on the under side of said sheet being traveled; said obverse-side printing unit is operative to perform printing on the upper side of said sheet being traveled; and said intermediate cylinder is used between said reverse-side printing unit and said obverse-side printing unit.

9. The sheet-fed press as set forth in claim 8, wherein said reverse-side printing unit and said obverse-side printing unit are arranged from the upstream side of the sheet traveling direction in the recited order.

10. The sheet-fed press as set forth in claim 9, further comprising imaging means provided under said intermediate cylinder, said imaging means being operative to photograph the reverse side of said sheet to inspect printing quality of said reverse side.

11. A sheet-fed press with the intermediate cylinder as set forth in claim 2.

12. The sheet-fed press as set forth in claim 11 wherein: a reverse-side printing unit and an obverse-side printing unit are arranged along a traveling path for said sheet; said reverse-side printing unit is operative to perform printing on the under side of said sheet being traveled; said obverse-side printing unit is operative to perform printing on the upper side of said sheet being traveled; and said intermediate cylinder is used between said reverse-side printing unit and said obverse-side printing unit.

13. The sheet-fed press as set forth in claim 12, wherein said reverse-side printing unit and said obverse-side printing unit are arranged from the upstream side of the sheet traveling direction in the recited order.

14. The sheet-fed press as set forth in claim 13, further comprising imaging means provided under said intermediate cylinder, said imaging means being operative to photograph the reverse side of said sheet to inspect printing quality of said reverse side.

15. An intermediate cylinder which is used in a sheet-fed press to convey a sheet, said intermediate cylinder comprising:

a main body;

at least one set of a gripping mechanism and a plurality of suction boxes, said gripping mechanism being disposed at a predetermined circumferential position of said main body and being to grip a front end of said sheet, and said plurality of suction boxes, each of which being to suck and hold a tail of said sheet whose front end is gripped by said gripping mechanism, being disposed in said main body at different distances from said gripping mechanism;

a plurality of suction bores formed in said suction boxes so that they are open at an outer peripheral surface of said main body;

a suction pump to generate suction force within said suction boxes; and a switching valve to switch connections between said plurality of suction boxes and said suction pump selectively.

* * * * *